US006646280B1

(12) United States Patent
Schaede

(10) Patent No.: US 6,646,280 B1
(45) Date of Patent: Nov. 11, 2003

(54) DEVICE AND METHOD FOR INSPECTING AND CUTTING STRIPS OF SECURITY DOCUMENTS

(75) Inventor: Johannes Georg Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/048,996

(22) PCT Filed: Aug. 11, 2000

(86) PCT No.: PCT/DE00/02695

§ 371 (c)(1),
(2), (4) Date: Feb. 20, 2002

(87) PCT Pub. No.: WO01/14235

PCT Pub. Date: Mar. 1, 2001

(30) Foreign Application Priority Data

Aug. 20, 1999 (DE) ..... 199 39 163

(51) Int. Cl.[7] ..... G01N 21/88; B41J 45/00

(52) U.S. Cl. ..... 250/559.01; 250/559.46; 101/483; 356/71

(58) Field of Search ..... 250/559.01, 559.05, 250/559.07, 559.08, 559.44–559.47, 556; 356/430, 429, 237.1, 71; 382/112, 135; 83/88; 101/224, 226, 483, 484

(56) References Cited

U.S. PATENT DOCUMENTS

| | | | | | |
|---|---|---|---|---|---|
| 4,463,677 | A | * | 8/1984 | Kuehfuss | 101/483 |
| 4,593,893 | A | * | 6/1986 | Suter | 270/52.12 |
| 4,677,910 | A | * | 7/1987 | Kuhfuss | 101/93.01 |
| 4,793,251 | A | * | 12/1988 | Kuhfuss | 101/93.01 |
| 5,193,423 | A | * | 3/1993 | Bakker | 83/24 |
| 5,598,006 | A | * | 1/1997 | Stringa | 250/559.46 |
| 5,608,639 | A | * | 3/1997 | Twardowski et al. | 700/125 |
| 5,623,850 | A | * | 4/1997 | Szczepaniak et al. | 73/159 |
| 6,112,658 | A | * | 9/2000 | Gunther et al. | 101/171 |

FOREIGN PATENT DOCUMENTS

| | | |
|---|---|---|
| CH | 669 945 A5 | 4/1989 |
| EP | 0 286 317 A1 | 10/1988 |
| EP | 0 612 042 A2 | 8/1994 |

* cited by examiner

*Primary Examiner*—Stephone B. Allen
(74) *Attorney, Agent, or Firm*—Jones Tullar & Cooper PC

(57) ABSTRACT

A device and a method for processing valuable documents, such as securities, involves the separating of sheets of such documents into strips of documents. These strips are inspected and are subsequently cut into individual valuable documents, such as banknotes.

11 Claims, 3 Drawing Sheets

DEVICE AND METHOD FOR INSPECTING AND CUTTING STRIPS OF SECURITY DOCUMENTS

FIELD OF THE INVENTION

The present invention relates to a device and to a method for processing securities. Strip-like printed material has a plurality of securities or bills arranged one behind the other. The strips are conveyed past an inspection device and are then cut transversely into individual security documents. The accuracy of the cuts is then checked.

DESCRIPTION OF THE PRIOR ART

CH 669 945 A5 describes a device for processing securities, wherein a sheet is imprinted with a plurality of copies. Here, a quality control of the individual copies is performed. The individual copies are also arranged linearly on the strips.

EP 0 286 317 A discloses a conveying device for conveying individual strips of securities. An inspection device with a downstream arranged transverse cutting device is provided there.

SUMMARY OF THE INVENTION

The object of the present invention is based on providing a device and a method for processing securities.

The object of the present invention is attained by processing strip-like materials that have a plurality of securities or bills arranged one behind the other. The individual strips are conveyed past an inspection device. This inspection device checks the images printed on the strips. Once the images have been checked, the strips are transversely cut. A cut checking device is positioned downstream of the transverse cutting device. The individual security documents can be arranged in stacks.

The advantages which are realized by the present invention consist, in particular, in that a device for processing securities creates "inline" stacks of individual checked securities, wherein an increased processing speed during inspection is possible in comparison with the inspection of individual securities.

The device is constructed to be narrow in comparison with the processing of sheets with a plurality of copies lying next to each other.

BRIEF DESCRIPTION OF THE DRAWINGS

Preferred embodiments of the present invention are illustrated in the drawings and will be described in greater detail in what follows. Shown are in.

DESCRIPTION OF THE PREFERRED EMBODIMENTS

Figure 1:
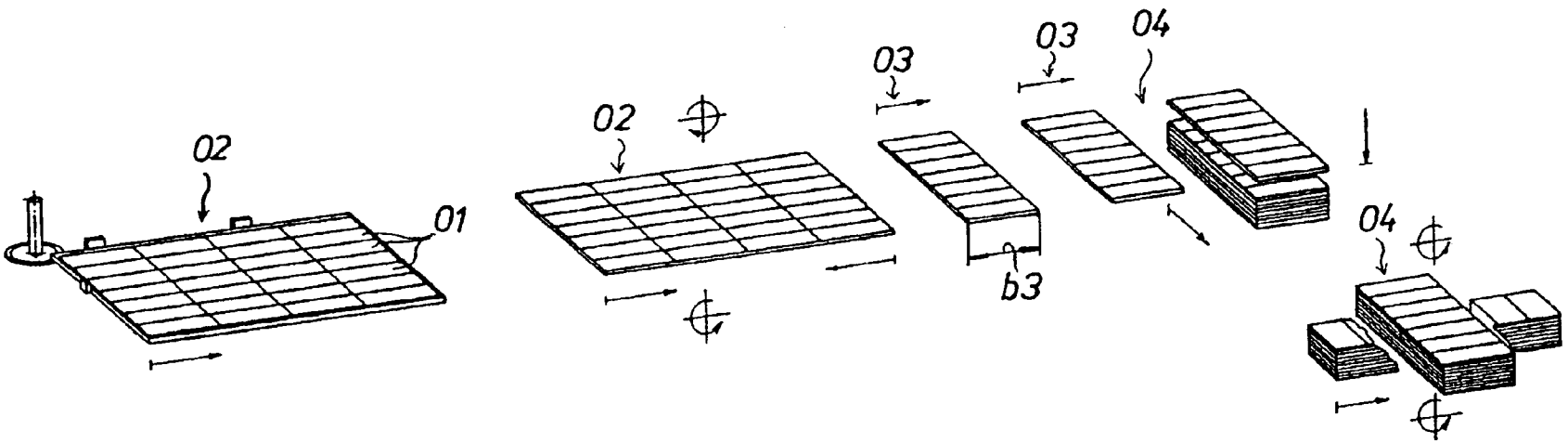
FIG. 1, a schematic representation of processing of sheets into strips.
Figure 3:
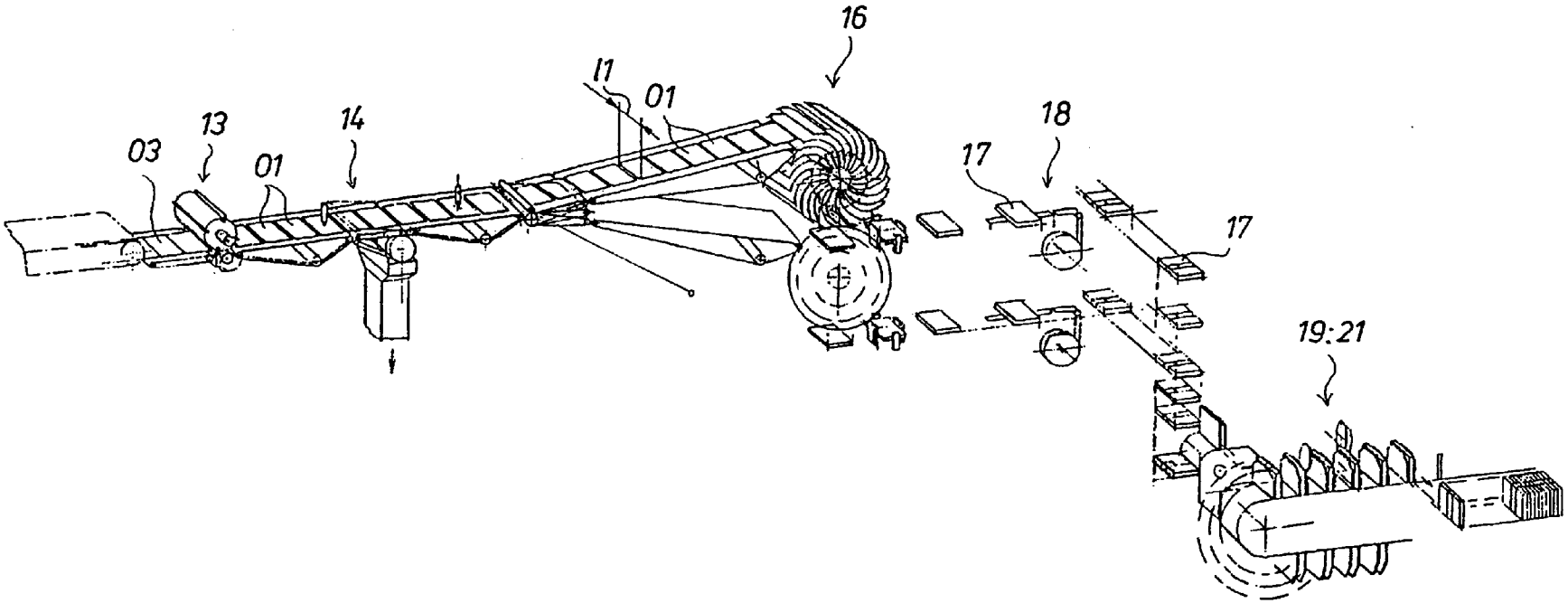

The edges are cut off a plurality of copies 01, for example bills, located behind and next to each other on imprinted sheets 02, as seen in FIG. 1. The sheets 02 are thereafter cut transversely to their initial direction of travel into strips 03. In this case, a width b3 of a strip 03 approximately corresponds to a length l1, as shown in FIG. 3, of the individual copy 01, i.e. the length of a bill. These strips 03 of a sheet 02 lying next to each other are then arranged in an appropriate sequence on top of each other to form stacks 04 consisting of strips 03, again as depicted in FIG. 1.

Figure 2:
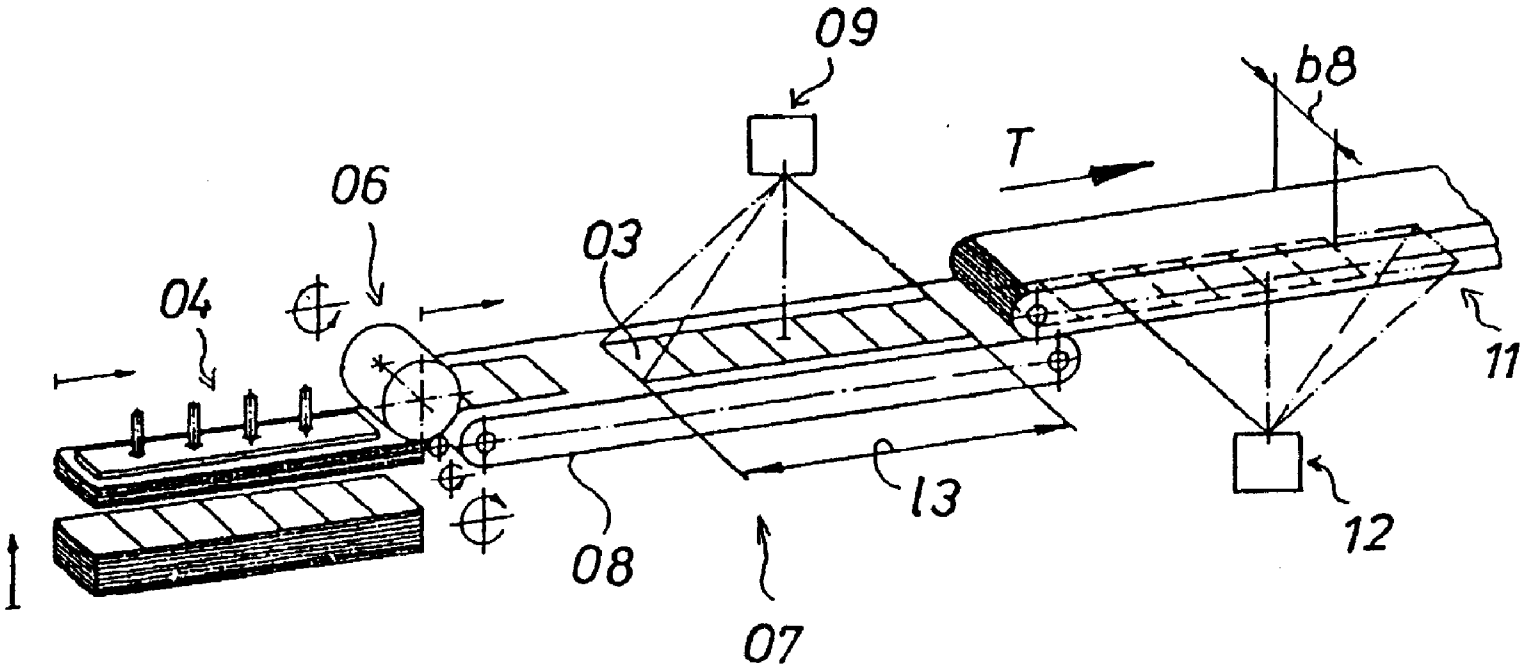
FIG. 2, a schematic representation of the processing of strips, including the inspection, and in FIG. 3, a schematic representation of the further conveyance of the strips following inspection, all in accordance with the present invention.

These stacks 04 are then arranged in such a way that their longitudinal axis now lies in the conveying direction T as shown in FIG. 2.

These stacks 04 are conducted to a separating device 06, which unstacks the strips 03 and conducts the strips 03 individually one behind the other to a first conveying device 07. This first conveying device 07 has a conveyor belt 08, or several conveyor belts 08 placed side by side. The conveyor belts 08 can be charged with a vacuum, i.e. the conveyor belts 08 can be charged with suction air. The width b8 of the conveyor belts 08 is adapted to the maximum width b3 of the strips 03 to be processed. The first conveying device 07 has an approximately straight section, whose length corresponds at least to a maximum length l3 of a strip 03 to be conveyed.

An inspection device 09, which checks a first side of the strip 03, is arranged opposite the first conveying device 07. This inspection device 09 has a CCD area camera, for example, and checks the printed image of a first side of the strip 03.

A second conveying device 11 is arranged downstream of the first conveying device 07. The second conveying device 11 is structurally identical to a large extent with the first conveying device 07, but faces the already checked first side of the strip 03.

The printed image of a second side of the strip is checked by means of a second inspection device 12 positioned opposite the second conveying device 11, as seen in FIG. 2.

A transverse cutting device 13 is arranged following the two conveying devices 07, 11 and cuts the strip 03, which was checked on both sides, into individual copies, as is shown in FIG. 3.

A device 14 for extracting copies 01 which have been found to be defective by the inspection devices 09, 12 is arranged downstream of the transverse cutting device 13. This device 14 for extraction is operated selectively as a function of a signal generated by the inspection devices 09, 12.

The copies 01 are subsequently conducted to a device for collection 16, for example a paddle wheel, and are deposited in stacks 17 of, for example, 100 pieces.

These stacks 17 of individual copies 01, for example bills, are conducted to a device 18 for being banded.

Thereafter, the individual banded stacks 17 are counted by means of a device 19 for counting individual bills, and are conducted to a device 21 for checking the cut.

While a preferred embodiment of a device and a method for processing valuable documents, such as security documents and bills, in accordance with the present invention has been set forth fully and completely hereinabove, it will be apparent to one of skill in the art that a number of changes in, for example, the type of printing press used to print the securities or bills, the drive devices for the conveying devices and the like could be made without departing from the true spirit and scope of the present invention which is accordingly to be limited only by the following claims.

What is claimed is:

1. A device for processing strips of printed materials, each said strip including a plurality of individual copies arranged one behind the other in said strip, said device comprising:

a first strip conveying device adapted to convey individual ones of said strips, said first strip conveying device having a width, said first strip conveying device width being at least the same as a maximum width of a strip to be processed, the maximum width of a strip to be processed corresponding to a length of one copy in the plurality of individual copies on each said strip of printed materials, said first strip conveying device including at least a first suction conveyor belt;

at least a first inspection device adapted to inspect a printed image on a first side of each of said strips, said first inspection device being arranged opposite and facing said first strip conveying device;

a transverse cutting device arranged after, in a direction of strip travel, said at least first inspection device, said transverse cutting device being adapted to cut said strips into individual copies; and a device for checking cutting of the individual copies, said device for checking cutting being arranged after said transverse cutting device.

2. The device of claim 1 wherein a length of each strip is a multiple of the width of each strip.

3. The device of claim 1 wherein said at least first inspection device is a CCD area camera.

4. The device of claim 3 further including first and second inspection devices.

5. The device of claim 1 further including a second strip conveying device positioned after, in said direction of strip travel, said first strip conveying device, and a second inspection device arranged opposite said second strip conveying device, said second strip conveying device including a second suction conveyor belt, said second inspection device being opposite said second suction conveyor belt.

6. The device of claim 1 wherein said first strip conveying device has a straight conveying section having a length, said length being at least equal to a maximum length of a strip of printed material to be processed.

7. The device of claim 1 further including a device for extracting individual copies, said extraction device being positioned after said transverse cutting device.

8. The device in accordance with claim 1 further including a copy collecting device and a copy stacking device arranged after said transverse cutting device.

9. The device of claim 8 further including a banding device after said copy collecting device.

10. The device of claim 8 further including a counting device after said copy collecting device.

11. A method for processing securities including:

providing a plurality of sheets with each of said plurality of sheets being imprinted with a plurality of copies of securities;

cutting each of said sheets into a plurality of strips with each said strip having a strip width corresponding to a copy length;

arranging said plurality of strips into stacks of strips;

providing a first strip conveying device including a first suction conveyor belt;

removing a top one of said strips from said stack of strips and conducting said removed strip to said first strip conveying device;

providing a first strip inspection device opposite said first suction conveyor belt and inspecting a first side of each imprinted strip during transport of said strips by said first strip conveying device;

providing a second strip conveying device including a second suction conveyor belt, and located after, in a strip conveying direction said first strip conveying device;

providing a second strip inspection device opposite said second suction conveyor belt and inspecting a second side of each imprinted strip during transport of said strips by said second strip conveying device;

cutting each said strip into a plurality of individual securities; and collecting said individual securities and arranging said individual securities to form a stack of securities.

* * * * *